US005340341A

United States Patent [19]

Yoshimura

[11] Patent Number: 5,340,341

[45] Date of Patent: Aug. 23, 1994

[54] POWER ASSISTING MECHANISM FOR MARINE PROPULSION UNIT

[75] Inventor: Tsuyoshi Yoshimura, Hamamatsu, Japan

[73] Assignee: Sanshin Kogyo Kabushiki Kaisha, Hamamatsu, Japan

[21] Appl. No.: 672,887

[22] Filed: Mar. 21, 1991

[30] Foreign Application Priority Data

Mar. 23, 1990 [JP] Japan ..... 2-75249

[51] Int. Cl.[5] ..... B63H 5/12

[52] U.S. Cl. ..... 440/61; 114/150; 440/86

[58] Field of Search ..... 114/150; 440/61, 84, 440/85, 86, 87

[56] References Cited

U.S. PATENT DOCUMENTS

| | | | |
|---|---|---|---|
| 2,618,235 | 11/1952 | Clark | 440/86 |
| 2,916,008 | 12/1959 | Bauer | 114/150 |
| 3,080,721 | 3/1963 | Mett et al. | 114/150 |
| 3,148,657 | 9/1964 | Horning | 114/150 |
| 3,256,852 | 6/1966 | Warburton | 440/61 |
| 4,262,622 | 4/1981 | Dretzka | 440/84 |
| 4,836,810 | 6/1989 | Entringer | 440/61 |

FOREIGN PATENT DOCUMENTS

| | | | |
|---|---|---|---|
| 2197275 | 5/1988 | United Kingdom | 440/86 |

*Primary Examiner*—Michael S. Huppert
*Assistant Examiner*—Thomas J. Brahan
*Attorney, Agent, or Firm*—Knobbe, Martens, Olson & Bear

[57] ABSTRACT

A marine propulsion unit steering and gear shift system that comprises a single source of hydraulic power, a steered device, a gear shift member, steering and gear shift control mechanism connected to their respective members and first and second power assist devices connected to the gear shift and steering control mechanism for power assist. A single substantially constant output hydraulic pump supplies an essentially constant level of fluid power for the first and second power assist devices to assist the operator in controlling the steering and gear shift controls.

9 Claims, 2 Drawing Sheets 11
13
15
17
19
21
23
25
27
29
33
35
37
39
41
43
45
47
49
51
53
55
57
59
61
63
67
69
71
129
183

Hydraulic pump output
Marine steering load
Automotive steering load
Operating range
Engine Speed
Output or load

POWER ASSISTING MECHANISM FOR MARINE PROPULSION UNIT

BACKGROUND OF THE INVENTION

This invention relates to a marine propulsion unit and more particularly to an improved apparatus for providing power assistance to the steering and gear shifting of a watercraft or the like.

In many marine applications the watercraft is steered, throttled, and gear shifted by an operator at a remote location. In order to effect steering and gear shifting, the steering device of the watercraft, either the rudder or the outboard drive, and the gear shift lever and throttle of the transmission of an engine, may each be operated by their associated control line.

Steering with control lines is often difficult, as is the case for shifting the gears of the engine due to the resistance encountered. With steering, and especially when turning at higher speeds, the resistance to steering is significant. In gear shifting, if the engine speed is too great during shifting, the gear shift mechanism may be damaged.

One solution to the problem has been the use of a fully automatic hydraulic control scheme. A fully hydraulic system, in the event of failure, causes the loss of all control. The alternative is an intricate backup system, engagable upon main hydraulic failure, to maintain control in the failure mode.

One alternative to the limitations described above involve the use of a power assisted mechanical control system for both the steering and gear shifting. One such system has employed a large hydraulic fluid pump to feed a pair of opposing hydraulic cylinders to achieve steering control. A separate hydraulic pump, is then needed to power the gear shifting action of the marine propulsion unit.

The problems noted in the preceding paragraph can be solved if a single hydraulic pump is employed to operate both of the power assisted controls. However, the size of the hydraulic pump will depend upon the maximum loads of the controlled devices. This can result in the use of large and expensive hydraulic pumps. There is a further need, therefore, to provide a hydraulic assist system wherein the power assisted loads have demands such that a smaller, constant displacement pump may be employed for operating a plurality of power assisted motors.

SUMMARY OF THE INVENTION

A first feature of this invention is adapted to be embodied in a marine propulsion unit steering and gear shift system that comprises a single source of hydraulic power, a steered device, a gear shift member, steering and gear shift controls and first and second power assist devices operated under the control of the steering and gear shift controls and powered by the single source of hydraulic power for operating the gear shift and steering.

Another feature of this invention is adapted to be embodied in a vehicle propelled by an internal combustion engine at varying speeds and having first and second control systems. A fluid pump is driven by the internal combustion engine and the pump has a substantially constant output throughout the speed range. A first power assisted device is powered by the pump and has a power requirement that decreases as the speed increases and a second power device is operated by the pump and has a load requirement that increases as the speed increases so that the constant output pump can supply two devices and be smaller than that required by the maximum power output of each device.

DETAILED DESCRIPTION OF THE PREFERRED EMBODIMENTS

Figures 1, 3:
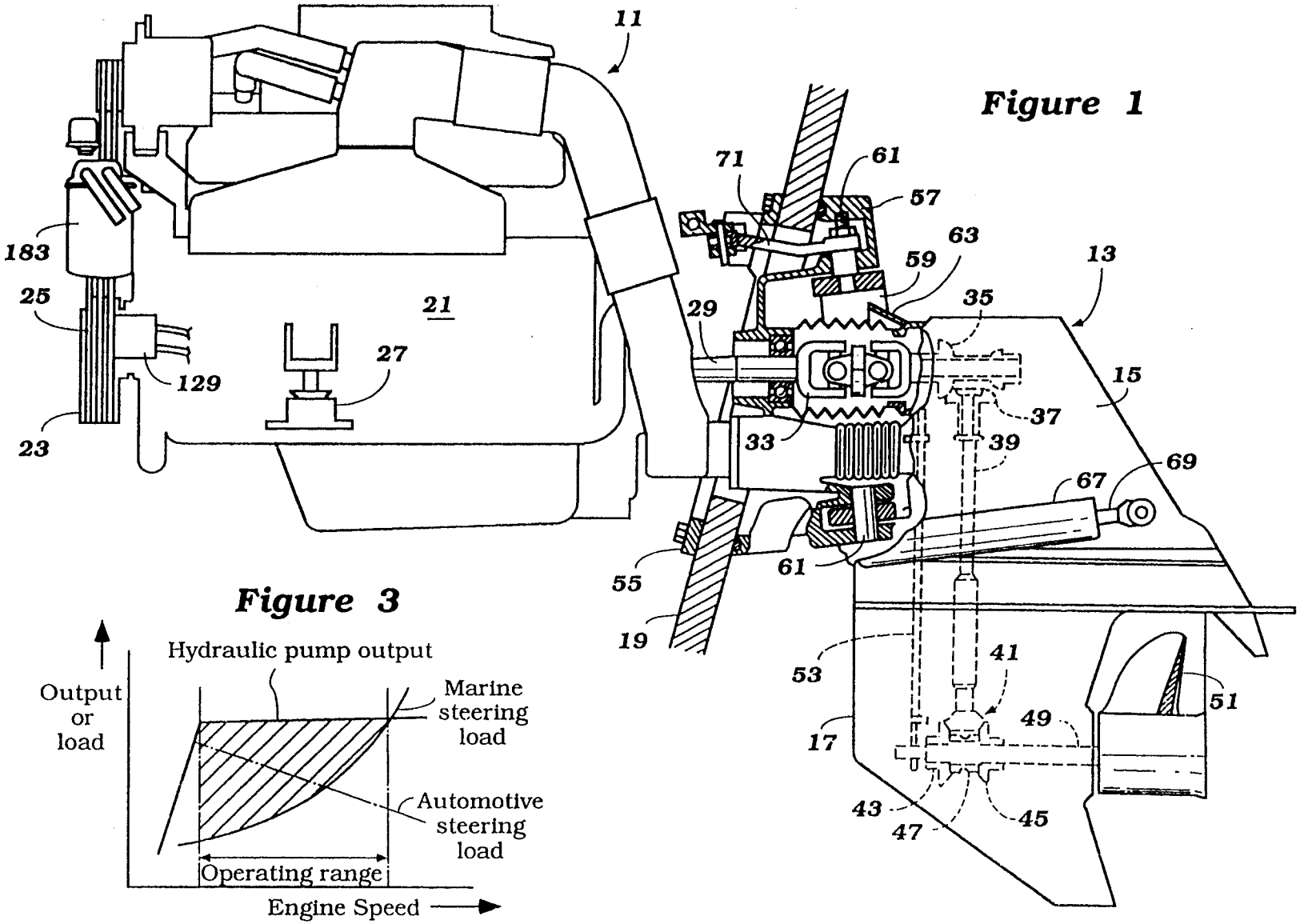
FIG. 1 is a side view of an outboard drive unit of an marine propulsion unit constructed in accordance with an embodiment of the invention.

Referring first to FIG. 1, a marine propulsion unit utilizing the steering controlling mechanism and propulsion unit controlling mechanism of the present invention as is illustrated, and is identified generally by the reference numeral 11. The propulsion unit controlling mechanism includes a gear shifting mechanism. The term "propulsion unit controlling mechanism" contemplates the use of both or either of the gear shifting and throttle controlling functions or any other control for a propulsion engine. The outboard portion of the marine propulsion unit 11 which extends into the water is the portion of marine propulsion unit 11 to be steered and is designated by the numeral 13, and may be referred to generally as a steered device. The steered device 13 may comprise a rudder, an outboard motor, or the outboard drive unit of an inboard/outboard drive, such as is illustrated in FIG. 1. In FIG. 1, steered device 13 part of an inboard/outboard propulsion unit, has a driveshaft housing 15 and a lower unit 17.

The inboard/outboard drive marine propulsion unit 11, hereafter inboard/outboard 11, mounts in a boat through the boat's transom 19. An internal combustion engine 21 has a main power takeoff pulley 23 attached to and driven by a crank shaft (not visible in the Figures). The main power take off pulley 23 drives a series of power transmission belts 25 to provide power to various devices in their path of travel. Engine mounts 27, one of which is shown in FIG. 1, support engine 21, in the hull of the boat.

With regard to power transmission of the inboard/-outboard 11, the crank shaft (not shown) of engine 21 drives a horizontal output shaft 29 extending aftwardly of engine 21 and through the transom 19. A bearing 31 surrounds the horizontal output shaft 29 adjacent a point where horizontal output shaft 29 extends through transom 19 for stability and to facilitate rotation of the horizontal output shaft 29 with as little friction as possible. Horizontal output shaft 29 is a part or an input shaft of a universal joint 33 to facilitate the angular transmission of mechanical power during tilting and steering of the steered device 13.

The other end of universal joint 33 extends into the driveshaft housing 15 and is connected to a bevel gear 35 which rotates about a generally horizontally extending axis. Bevel gear 35 engages and drives a bevel gear 37 which rotates about a generally vertically extending axis. Bevel gear 37 is attached to a vertically oriented drive shaft 39 which extends downwardly within steered device 13. In the lower unit 17 of steered device 13, the drive shaft 39 is drivably attached to a driving bevel gear 41. The driving bevel gear 41 drivably turns an axially spaced pair of driven bevel gears 43 and 45 of a forward/neutral/reverse transmission assembly, indicated generally by the reference numeral 47. The transmission assembly 47 is provided for selectively driving a propeller shaft 49, that is journaled in the lower unit 17, in either a forward or reverse direction. A propeller 51 is affixed to the outer end of the propeller shaft 49 as is well known in the art.

The selectability of forward and reverse drive or neutral of the steered device is accomplished by a mechanical linkage 53. The mechanical linkages such as mechanical linkage 53 are well known and a variety of ways to mechanically operate forward/neutral/reverse transmission assembly 47 are known in the art.

The structural support for the steered device 13 includes bolted attachment to transom 19 on the inboard side by a plate 55 to which a transom plate or gimbal housing 57 is bolted thereto through the transom 19. Gimbal housing 57 pivotally supports a gimbal ring 59 for steering movement of the steered device about a generally vertically extending axis about a pair of vertical axis steering pins 61. A housing portion 63 of the driveshaft housing 15 is connected to the gimbal ring 59 for tilting movement about a generally horizontally extending axis defined by a pair of horizontal axis gimbal pins 65, shown in FIG. 2, so that the angular position of the steered device 13 of the inboard/outboard 11 may be adjusted to various trim adjusted positions and to a tilted up, out of the water position. The angle of tilt of steered device 13 is fixed by a pair of tilt cylinders 67 pivotally attached to gimbal housing 57 and their tilt cylinder rods 69 pivotally attached to steered device 13.

Tilt cylinders 67 and tilt cylinder rods 69 are hydraulically actuated through a tilt system (not shown). Both the axis of tilt and the axis of steering extend through the universal joint 33, such that the steered device 13 may be moved about while the propeller 51 continues to receive power.

A steering arm 71 is connected to be angularly pivoted with the upper of the vertical axis steering pins 61. As is shown in FIG. 2, steering arm 71 extends through and has some angular clearance with respect to transom 19.

Figure 2:
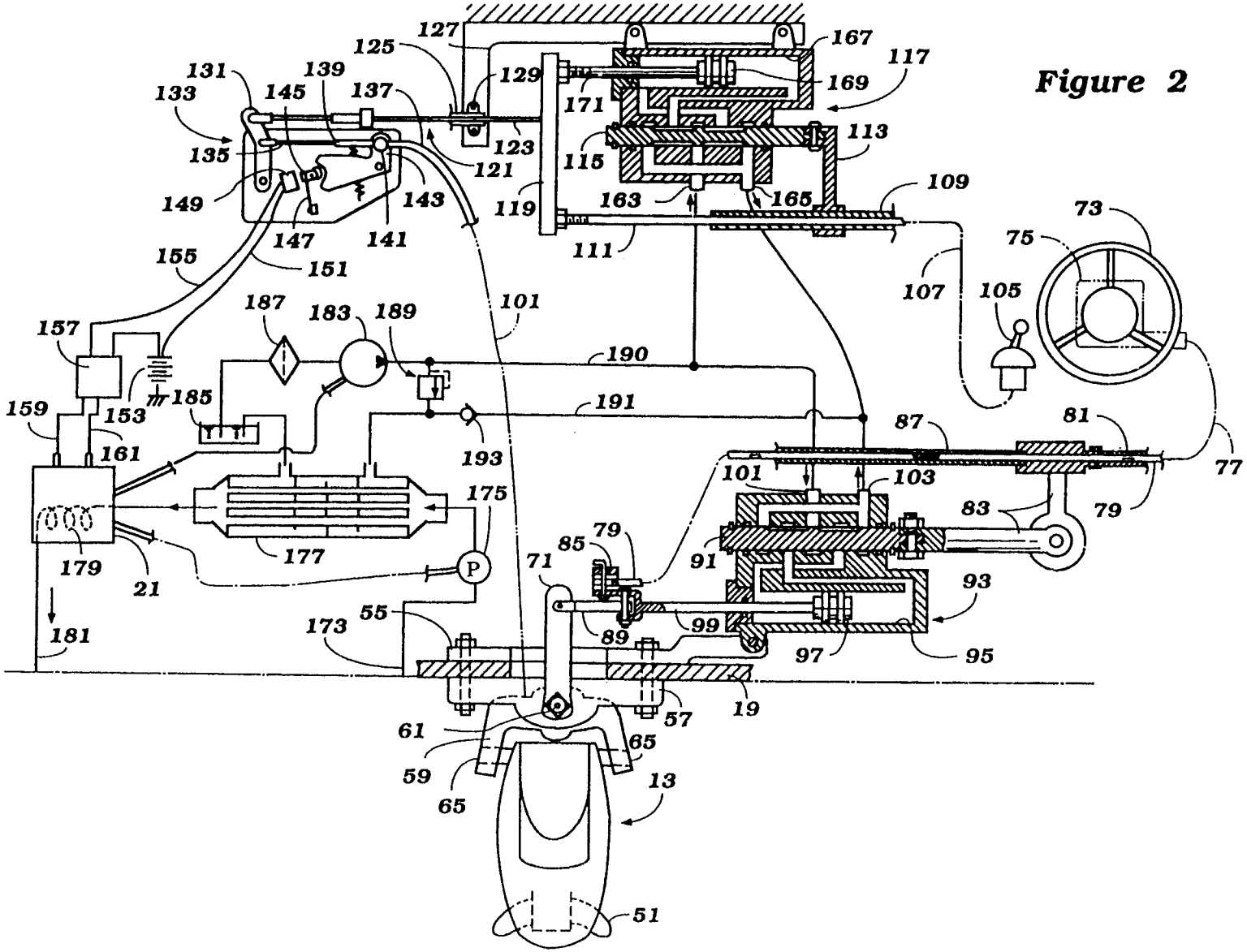
FIG. 2 is a partially schematic view of a steering and gear shift system for the marine propulsion unit constructed in accordance with an embodiment of the invention; and, FIG. 3 is a graph describing the relationship between hydraulic pump output, marine steering load, and automotive steering load, versus engine speed.

Referring to FIG. 2, steering arm 71 and the structures which are used to pivotally actuate it are shown partially in schematic view and partially in top view of the steered device 13 of FIG. 1. The operation of the steering of steered unit 13 is best explained beginning with the point at which the operator of the boat actuates the controls for controlling inboard/outboard 11.

A steering wheel 73 is rotatably supported by a steering mast 75, to facilitate the operation of inboard/outboard 11 in a known manner. The steering wheel 73 operates a cable 77 for mechanically transmitting control. Cable 77 may be a flexible transmitter such as a bowden wire actuator including an inner wire 79 within a sheath 81. Sheath 81 is connected to a control valve arm 83. Inner wire 79 is allowed to move freely through valve arm 83 and terminates at a clamp 85 where it is securely fixed. A link 89 is rigidly attached to clamp 85 at one end and pivotally attached to steering arm 71 at its other end.

In this manner, angular displacement of the steering wheel 73 causes the inner wire 79 of cable 77 to be displaced axially with respect to sheath 81. Movement of the inner wire 79 directly applies pivotal force to steering arm 71 to cause steered device 13 to pivot about the horizontal axis. The pivoting of steered device 13 effects the steering of the boat in which inboard/outboard 11 is attached, in a well known manner.

With the mechanical linkage just described, it can be seen that steering can occur in a directly mechanical manner. However, to assist the operator of a boat having inboard/outboard 11, a power assist device is located along the mechanical control linkage just described in order to provide part of the energy necessary to actuate the steering control. The valve control arm 83 is connected to an open center valve element 91 within a steering power cylinder unit 93. Steering power cylinder unit 93 defines a cylinder 95 containing a piston 97. Piston 97 is connected to a piston rod 99. The other end of piston rod 99 is pivoteded to the link 89 and the clamp 85. Steering power cylinder unit 93 has a hydraulic fluid inlet 101 and a hydraulic fluid outlet 103.

The active operation of steering power cylinder unit 93 is as follows. The differential movement of valve 91 to one side or the other will cause the flow of more hydraulic fluid to one side of piston 97 to thereby drive the piston rod 99. The movement of valve 91 is accomplished by the relative motion between the inner wire 79 which is affixed to clamp 85 and the sheath 81 which is affixed to control valve arm 83. If inner wire 79 is displaced away from mast 75, the sheath 81 will be relatively displaced toward mast 75, as would valve 91. The relative displacement of valve 91 with respect to steering power cylinder unit 93 causes hydraulic fluid to enter the cylinder 95 on the side of piston 97 opposite its connection to piston rod 99. This causes the piston 97 to supply force against steering arm 71 to turn steered device 13. As steering arm 71 is displaced away from steering power cylinder unit 93, inner wire 79 moves with respect to sheath 81, mitigating the force between these two elements. As this force is mitigated, the valve 91 returns to its center, normal position to then cease supplying fluid power to piston 97.

With regard to gear shift power assisting, a gear shifter 105, the first portion of a gear shift control portion of a propulsion unit control, is pictured as a lever by which the operator of a boat may select the forward, neutral, or reverse drive. Gear shifter 105 may also be part of a combined single lever transmission and throttle control. A cable 107, attached to gear shifter 105, is of the bowden cable type previously described, having a sheath 109 and an inner wire 111.

The remote end of the sheath 109 is connected to a control valve arm 113 of a valve 115 of a gear shift power cylinder unit 117. The inner wire 111 portion of cable 107 is connected to a movable displacement bar 119. Displacement bar 119 is connected to a second cable 121, also of the bowden wire actuator type. The inner wire 123 of cable 121 is connected to displacement bar 119. The sheath 125 is affixed to a structural arm 127 which is rigidly affixed to the watercraft in which inboard/outboard 11 operates by bracket 129.

The other end of cable 121 is connected to-one end of a lever 131 which is pivotally attached to shift detecting mechanism 133, which operates as a shift assist sensor by sensing resistance to shifting and reducing the speed of the engine in the event a large resistance is encountered. Lever 131 pivots upon movement of inner wire 123 of cable 125. Spaced from the end of lever 131, an inner wire 135 of a cable 137 is pivotally attached to the lever 131. Cable 137 has a sheath 139 which is affixed to a support 141 mounted on one arm of a bell crank 143 which is pivotally attached to shift detecting mechanism 133.

The other arm of bellcrank 143 has a concave profile. Within the innermost portion of the concave profile of the end of bellcrank 143 a roller arm 145 resides. Roller arm 145 is attached to a leaf spring arm 147, which is in turn attached to shift detecting mechanism 133. In this manner, roller arm 145 is urged toward bellcrank 143, but may be displaced upon pivotal movement of bellcrank 143.

Movement of roller arm 145, away from bellcrank 143 through movement of bellcrank 143 in either direction, will bring it into contact with a switch 149. Switch 149 has a first lead 151 connected to the positive terminal of a battery 153 and a second lead 155 connected to a spark control 157. Battery 153 is also poweringly connected to spark control 157. Spark control 157, upon receiving a signal from switch 113 that gear shifting activity is occurring, acts to interrupt the ignition of engine 21 to slow the speed of engine 21 to facilitate the shifting of gears. Shifting of gears at too high a power from engine 21 could cause damage to the forward/neutral/reverse transmission assembly 47. Spark control 157 fires the spark plugs of engine 21, through spark plug wires 159 and 161.

Similar to steering power unit 93, gearshift power cylinder unit 117 has a hydraulic fluid inlet 163, hydraulic fluid outlet 165, and cylinder 167 supporting a piston 169. A piston rod 171 is attached at one end to piston 169 and at the other end to displacement bar 119. Gearshift power cylinder unit 117 is rigidly attached to support 127.

Gearshifting is accomplished mechanically, with a power assist from gearshift power cylinder unit 117, in the same manner as was the case for steering power cylinder unit 93. Likewise, upon the failure of a source of hydraulic power, gearshifting is accomplished mechanically without a power assist.

Engine 21 of FIG. 1 is represented in a side view, whereas engine 21 of FIG. 2 is schematically represented in the form of a box. The engine 21 provides fluid power and cooling to the power assisting mechanism system of the present invention.

Marine engines are known to draw cooling water from the body of water in which they operate. A cooling water intake inlet 173 supplies cooling water from the inboard/outboard 11 lower unit to a pump 175. Pump 175 is illustrated in both of FIGS. 1 and 2. In FIG. 1 it can be seen that pump 175 is driven by one of the drive belts 25 powered by engine 21. A portion of the cooling water pumped from pump 175 is delivered to cooling water input of a hydraulic fluid heat exchanger 177. From hydraulic fluid heat exchanger 177, the cooling water exits the cooling water exit of heat exchanger 177 and enters engine 21 for discharge back to the body of water with the coolant from the engine. From the cooling system 179, the heated cooling water exits the engine through an exit line 181 where it is returned to the body of water from which it was originally taken.

Referring again to both FIGS. 1 and 2, a power fluid or hydraulic fluid pump 183 is attached to engine 21 and takes mechanical power therefrom by utilizing one or more of the drive belts 25. Pump 183 has a substantially constant output profile over a finite range of operating speeds of the engine 21. Such a constant output hydraulic pump 183 is the type typically utilized in automotive applications, such as the power steering of an automobile.

Hydraulic pump 183 draws hydraulic fluid from a reservoir 185 through a filter 187. A pressure relief valve 189 is connected across the pressure line of the pump 183 and to a return line to be later described.

The output of hydraulic pump 183 is connected to the hydraulic fluid inlet 163 of gear shift power cylinder unit 117, and to the hydraulic fluid inlet 101 of a steering power cylinder unit 93 through a hydraulic fluid line 190. Hydraulic pump 183 having a substantially constant output profile takes advantage of the fact that marine steering load increases with speed, while gear shifting occurs at low speeds, as will be later described. By utilizing a single hydraulic pump 183 to supply hydraulic fluid to both the gear shift power cylinder unit 117, and the steering power cylinder unit 93, instead of two hydraulic pumps, a savings of cost and space results. In addition, the constant output hydraulic pump 183 is of the type used in automotive applications. Due to the mass production of this type of hydraulic pump in the automotive industry, it should be more inexpensively obtainable. The hydraulic fluid outlet 165 of gear shift power cylinder unit 117 and the hydraulic fluid outlet 103 of the steering power cylinder unit 93 return hydraulic fluid to be recirculated through the hydraulic power system through a return line 191.

The hydraulic fluid outputs 103 and 165 return fluid to the heat exchanger 177 through return line 191 in which a check valve 193 is positioned to prevent back flow of hydraulic fluid into return line 191. The outlet of check valve 193 is in communication with the outlet of relief valve 189, and both are in communication with the hydraulic fluid inlet of heat exchanger 177. The hydraulic fluid output from the heat exchanger 177 is connected to the hydraulic fluid reservoir 185.

Referring to FIG. 3, a graph describing the relationship between hydraulic pump output, marine steering load, and automotive steering load, versus engine speed is shown. Note that for a finite, but wide, range of operating engine 21 speeds that the hydraulic pump 183 output is constant, or flat between the dashed line verticals. As the boat (not shown) within which inboard/outboard 11 is placed increases in speed, the steering of steered device 13 becomes increasingly difficult due to the increasing resistance against steered device 13 by the surrounding water. Thus, the marine steering load is seen to increase gradually with engine speed, reaching a level at the high end of the engine speed range shown to be approximately equal to the flat profile of the hydraulic pump output.

Automotive steering load, by comparison, is known to be relatively high at low engine speeds and decreasing at higher operating and engine speeds. Thus, over the finite operating range delineated by the vertical dashed lines, it is seen that automotive steering load, also represented by a dashed line having a negative slope, decreases linearly over the finite engine speed range.

Gear shifting necessarily occurs at very low engine speeds, usually at idling speed or even lower, to minimize wear and strain on the forward/neutral/reverse transmission assembly 47. It can be readily seen that the employment of power for gear shifting at low speeds would be inconsistent with the automotive steering load profile. However, the excess fluid power capacity with the marine system is demarked with slanted line shading, and shows that there is excess fluid power capacity throughout the range and that the maximum excess fluid power capacity occurs at the lower end of the engine speed range, where gear shifting in the marine system would be expected to occur. In summation, the curve of FIG. 3 illustrates that there is more than enough excess hydraulic fluid power capacity to facilitate power assisted steering along with power assisted gear shifting utilizing a single, constant output, hydraulic pump of the type normally utilized in automotive applications.

The foregoing disclosure and description of the invention is illustrative and explanatory of a preferred embodiment of the invention, and various changes of the illustrated construction may be made without departing from the spirit and scope of the invention.

What is claimed is:

1. A vehicle having an internal combustion engine operable over a speed range for operating said vehicle, a first vehicle control system, a first hydraulic assist device operating said first vehicle control system, a second vehicle control system, a second hydraulic power assist device for operating said second vehicle control system, a fluid pump driven by said engine and providing a substantially constant output of fluid under pressure over the speed of range of operating of said engine, means for supplying said first and said second hydraulic power assist devices with fluid from said fluid pump, said first vehicle control system being operated only at low speeds and said second vehicle control system requiring a power for its operation that increases with vehicle speed.

2. The system of claim 1 wherein the first control system comprises a transmission.

3. The system of claim 1 wherein the second control system comprises a vehicle steering system.

4. The system of claim 3 wherein the first control system comprises a transmission.

5. The system of claim 1 wherein the vehicle comprises a water vehicle.

6. The system of claim 5 wherein the first control system comprises a transmission.

7. The system of claim 5 wherein the second control system comprises a vehicle steering system.

8. The system of claim 7 wherein the first control system comprises a transmission.

9. A vehicle as set forth in claim 1 wherein the internal combustion engine is provided with a cooling jacket and further including means for circulating coolant through said engine cooling jacket, a heat exchanger through which the fluid pumped by said fluid pump is circulated, and means for circulating engine coolant through said heat exchanger for heat exchange between the coolant of said engine and the hydraulic fluid pumped by said fluid pump.

* * * * *